US005944172A

United States Patent [19]

Hannula

[11] Patent Number: 5,944,172

[45] Date of Patent: Aug. 31, 1999

[54] BIASING ASSEMBLY FOR A SWITCHING DEVICE

[75] Inventor: Raymond H. Hannula, Delafield, Wis.

[73] Assignee: Allen-Bradley Company, LLC, Milwaukee, Wis.

[21] Appl. No.: 08/944,386

[22] Filed: Oct. 6, 1997

[51] Int. Cl.[6] ..... H01H 5/06

[52] U.S. Cl. ..... 200/401; 74/97.1

[58] Field of Search ..... 200/401, 443, 200/446; 74/97.1

[56] References Cited

U.S. PATENT DOCUMENTS

| | | | |
|---|---|---|---|
| 2,469,336 | 5/1949 | Kohl | 74/97.1 |
| 3,959,615 | 5/1976 | Zaffrann, Jr. et al. | 200/446 |
| 5,004,875 | 4/1991 | Moody et al. | 200/401 X |

*Primary Examiner*—Renee S. Luebke

*Attorney, Agent, or Firm*—Patrick S. Yoder; John M. Miller; John J. Horn

[57] ABSTRACT

A biasing assembly for a switching device is formed in a modular enclosure that may be mounted on either left or right sides of the switching device. The biasing assembly interfaces with the switching device to rapidly move the switching device between first and second stable positions, such as corresponding to open and closed contact orientations. The biasing assembly includes a hub and link plate coupled to a spring assembly. A spring in the spring assembly is precharged by initial movement of an actuating handle. Once a predetermined intermediate position is reached, a double roller arrangement is displaced along a support surface to rapidly toggle the spring assembly, link plate and hub to a second position. The enclosure includes abutment surfaces for stopping and holding the link plate in stable positions. The rolling contact afforded by the spring assembly rollers permits extremely rapid displacement and rolling friction during displacement of the assembly.

21 Claims, 6 Drawing Sheets

BIASING ASSEMBLY FOR A SWITCHING DEVICE

BACKGROUND OF THE INVENTION

1. Field of the Invention

The present invention relates generally to the field of biasing and actuator devices for electrical switches, disconnects, contactors and the like. More particularly, the invention relates to an innovative biasing structure incorporating rolling elements for shifting an actuator between stable, biased positions by rolling contact of the rolling elements against one another. The invention also relates to a modular structure for attachment of the biasing assembly to a switching device.

2. Description of the Related Art

A variety of actuators and biasing arrangements are known and presently available for switching devices such as contactors, disconnects and the like. In general, such actuators may be manually or remotely operated, such as by a lever arm coupled to a rotary shaft. In one known family of disconnects, blade-type conducting elements are secured to a rotary shaft and are moved between conducting and non-conducting positions by rotation of the shaft. In the conducting position, the conductors complete current-carrying paths through the device. Such disconnects may include fuses such that, when installed, the device completes current-carrying paths through the fuses to a downstream load.

In order to avoid unnecessary heating and arcing in switching devices of the type described above, a rapid snap-action mechanism is generally associated with the device to urge the conductors rapidly into either their conducting or non-conducting position. In manually-operated devices, the mechanism is moved from its stable positions by movement of the manual actuating lever. The mechanism is pre-loaded by initial movement of the actuating lever and, once a predetermined intermediate position is reached, snaps or toggles from its first (e.g., non-conducting) position to its second (e.g., conducting) position. The mechanism operates in an opposite sense to rapidly shift the switching device back from the latter position to the first position when the lever is moved in an opposite direction.

Various forms of biasing mechanisms have been proposed in the art. Most mechanisms include some form of toggle which is pre-loaded by the initial movement of the actuating lever, and which moves rapidly to an over-center position under the influence of a compression or tension spring. The particular configuration of the biasing device, including lever arm lengths, pivot axis positions, spring coefficients and bearing surface areas combine to determine the force with which the biasing device must be pre-loaded and the corresponding force and speed with which the device snaps between its stable positions. In general, a balance must be struck between the physical size and weight of the biasing device and the forces required to actuate it and to stop the moving components once they arrive in the stable positions. Moreover, bearing surfaces and forces are particularly important in the design of the biasing devices insomuch as they have an important impact on the speed with which the device moves between the pre-loaded, intermediate position and the subsequent stable position.

While many known biasing devices for switches provide generally adequate reliability, they are not without drawbacks. In particular, due to the layout and construction of bearing surfaces in most known toggle-type structures, the speed of actuation is limited. While the speed could be increased by pre-loading the toggle with a higher coefficient (i.e., stiffer) biasing spring, the resulting pre-load forces and impact forces upon the actuator reaching the stable positions become unacceptably high. Such forces can be accommodated by either reconfiguring the entire mechanism or by providing much more robust, and consequently more expensive and heavy mechanical linkages, stops and bearings within the device. Moreover, while many industrial disconnects and similar switching devices offer the flexibility of mounting actuators on either side of their housings, known biasing devices do not provide sufficient modularity to permit them to be easily installed on either side of the device without some disassembly and reassembly.

There is a need, therefore, for an improved biasing mechanism for disconnects, contactors, and other switching devices which addresses and avoids these drawbacks. In particular, there is a need for an improved biasing device structure which effectively overcomes the limitations of existing devices with respect to bearing forces and surfaces, which otherwise limit the rapidity with which the device moves between its stable positions. There is also a need for such an improved biasing device configured in a modular structure which can be quickly and easily mounted to either side of a switching device without requiring extensive disassembly and reassembly.

SUMMARY OF THE INVENTION

The invention provides an innovative biasing mechanism designed to respond to these needs. The mechanism has a straightforward construction which can be built in a relatively compact modular enclosure. The enclosure is interfaced with the switching device via a simple mechanical linkage, and can be easily mounted on either the left or right side of the switching device, as desired. The biasing structure employs a novel double-roller bearing configuration. Axially aligned rollers are urged by a biasing spring against a stop in a first stable position of the device. The device is pre-loaded by compression of the biasing spring. When an actuator within the device passes a predetermined intermediate position, the rollers are caused to roll against one another, moving from the stop and along a support surface to a second stop corresponding to the second stable position of the device. The device thus shifts between stable positions by rolling contact of the rollers against one another and against the support surface. The structure thus provides extremely rapid shifting between the intermediate and biased positions and, consequently, reduced arcing in the switch on which the biasing device is mounted.

Thus, in accordance with the first aspect of the invention, a biasing device is provided for a switching mechanism. The switching mechanism includes a switching element coupled to an actuator and movable with the actuator between a first position and a second position. The biasing device includes a biasing link, a support surface, and first and second roller elements. The biasing link has a head portion and a foot portion, the head portion being coupled to the actuator. The support surface has a central portion bounded by first and second stop portions. The roller elements are coupled to the foot portion of the biasing link and contact one another in rolling contact. The first roller rests against and is supported by the support surface. Means are included for urging the first and second roller elements away from the head portion of the biasing link. The urging means also contact the second roller element. The biasing device is movable by rolling contact of the first roller element with the second roller element between a first stable position wherein the device urges the actuator into the first position and a second stable position wherein the device urges the actuator into the second position.

In a particularly preferred configuration, the roller elements are pin or needle-like rollers which are captured in an elongated slot formed in the biasing link. The means for urging may conveniently include a compression spring and a roller sleeve. The spring urges the roller sleeve into contact with the second roller element, which is movable by rolling motion along the sleeve during movement of the biasing assembly between its stable positions.

The invention also provides an actuator assembly for urging a switching device into first and second positions. The assembly includes an enclosure, a mechanical linkage extending between the enclosure and the switching device, an actuator rotatably disposed in the enclosure, and a biasing assembly. The biasing assembly is disposed within the enclosure and is coupled to the actuator. The biasing assembly includes a biasing link coupled to the actuator, a pair of roller elements coupled to the biasing link, and a biasing spring. The biasing spring urges the roller elements against one another. The biasing assembly is movable by rolling engagement of the roller elements against one another to urge the biasing link, the actuator, and the mechanical linkage into a first stable position corresponding to the first position of the switching device and into a second stable position corresponding to the second position of the switching device.

In accordance with a further aspect of the invention, a modular biasing assembly is provided for urging a switching device into first and second positions. The switching device has left and right sides and the modular biasing assembly has a housing which is configured for mounting on either the left or the right side of the switching device. A mechanical linkage extends between the modular housing and the switching device. A toggle assembly is disposed in the modular housing and includes an actuator, a biasing link, a biasing spring, and a pair of rollers. The biasing spring urges the rollers into contact with one another, whereby the actuator is movable between positions corresponding to the first and second positions of the switching device by rolling movement of the rollers against one another. The toggle assembly preferably includes a support surface against which one of the pair of rollers bears during movement of the toggle assembly. The roller elements are preferably captured within an elongated slot in the biasing link.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Figure 1:
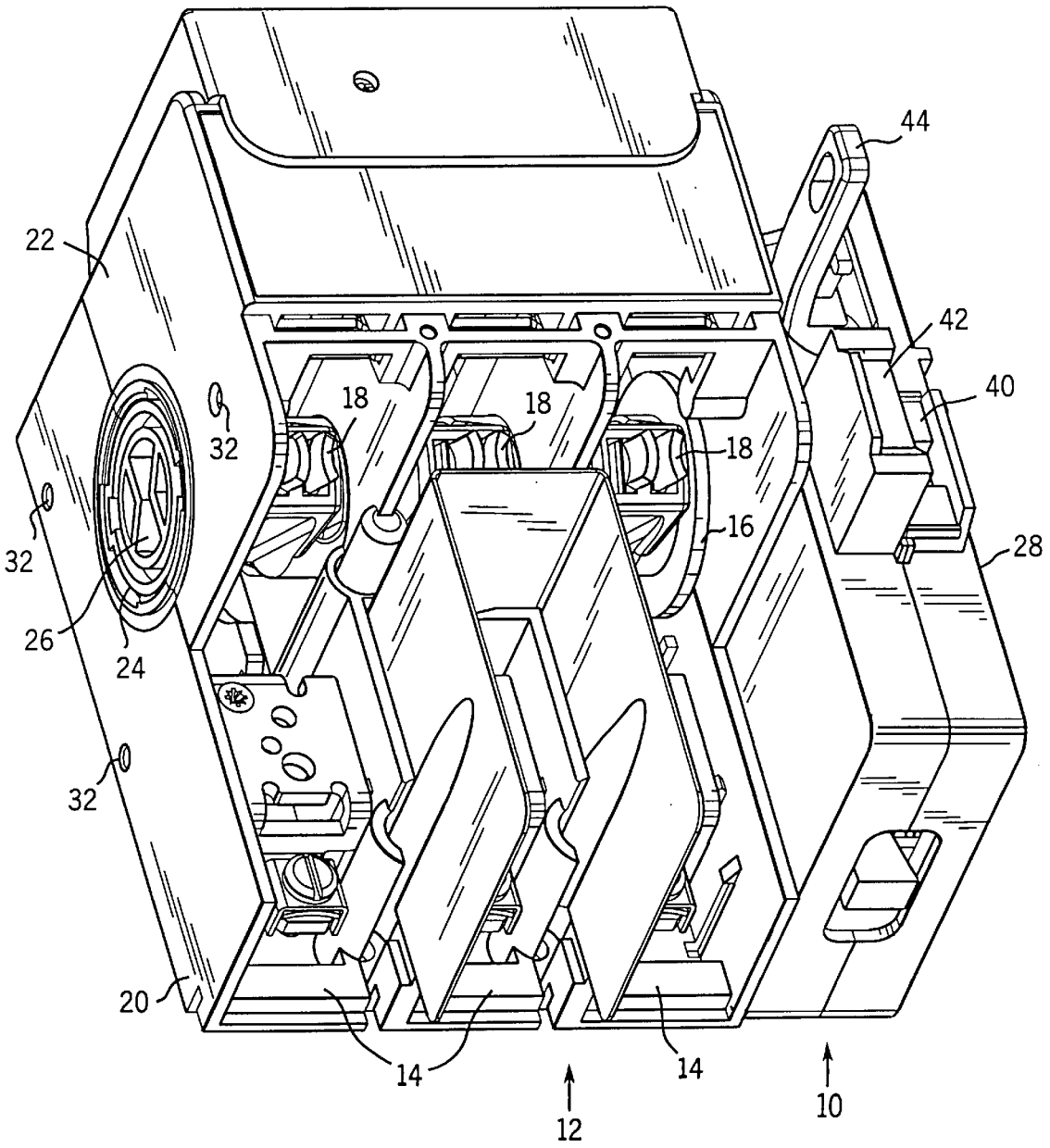
FIG. 1 is a top perspective view of a three-phase disconnect on which a modular biasing assembly in accordance with the invention is mounted.

Turning now to the Figures and referring first to FIG. 1, a biasing assembly, designated generally by the reference numeral 10, is illustrated mounted on a switching device 12. As illustrated in FIG. 1, switching device 12 is a three-phase disconnect having power phase sections 14 aligned parallel with one another for conducting electric current between conductors (not shown). A rotating member 16 carries movable contacts 18 for completing current carrying paths through each power phase section 14 in manner generally known in the art. Switching device 12 includes a housing 20 supporting both phase sections 14 and rotating member 16, as well as other functional components. Housing 20 has side panels 22 configured for supporting and interfacing with biasing assembly 10. Accordingly, rotating member 16 includes an interface end 24 terminating generally flush with each side panel 22. Interfacing apertures 26 are formed in each interface end 24 for cooperating with biasing assembly 10 to rapidly rotate member 16 between first and second stable positions as described more fully below. As will be appreciated by those skilled in the art, the stable positions of rotating member 16 will typically correspond to positions of contacts 18 in which current carrying paths through switching device 12 are either established or interrupted.

Figure 2:
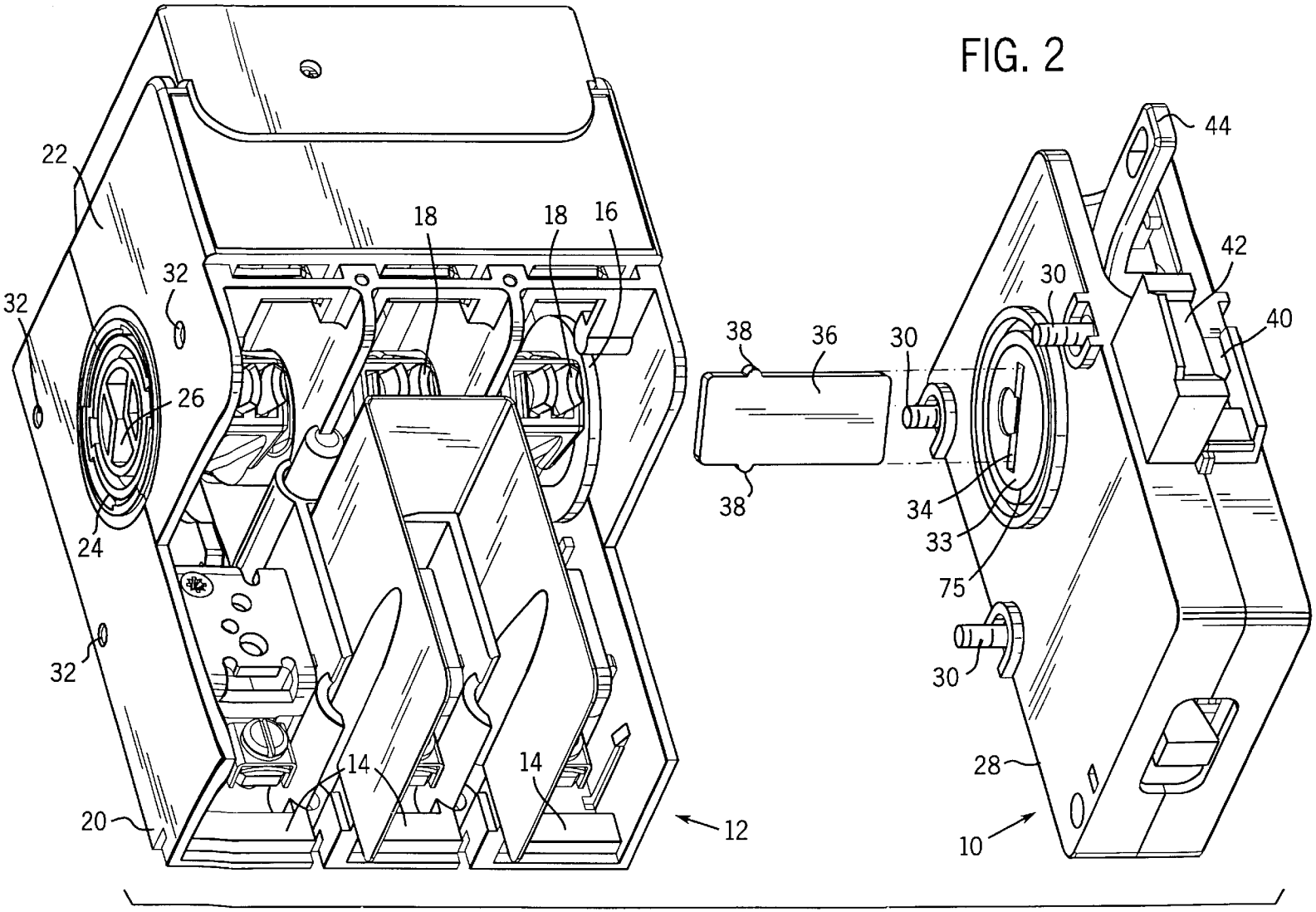
FIG. 2 is a partially exploded view of the disconnect and modular biasing assembly illustrated in FIG. 1 depicting a preferred manner in which the two devices are interfaced mechanically with one another.

In the preferred embodiment illustrated, biasing assembly 10 is configured in a modular housing 28 adapted to be interchangeably mounted on either the left or right side panel 22 of switching device 12. Thus, fasteners 30 may be secured through modular housing 28 and into threaded apertures 32 in device housing 20, as best illustrated in FIG. 2. A rotatable drive hub 33 terminates on either side of modular housing 28 and includes a drive aperture 34 for receiving a removable drive member or tang 36. Drive member 36, which includes a pair of lateral projections 38, is preferably formed as a flat metallic key which is slidable within both drive aperture 34 of drive hub 33, and aperture 26 of switching device 12. Projections 38 abut rotating member 16 as drive member 36 is positioned between switching device 12 and biasing assembly 10 during assembly, to limit the depth of penetration of drive member 36 into rotating member 16. Once positioned between biasing assembly 10 and switching device 12, drive member 36 transmits torque between drive hub 33 and rotating member 16 as described more fully below.

In the preferred embodiment illustrated, modular housing 28 includes an auxiliary contact interface structure 40 designed to receive one or more auxiliary contact devices 42. As will be appreciated by those skilled in the art, such auxiliary contacts are useful for providing feedback or monitoring signals indicative of the actual position of rotating member 16. An actuating lever 44 is accessible through modular housing 28 for moving biasing assembly 10 between first and second stable positions. As will be appreciated by those skilled in the art, once installed, actuating level 44 may be coupled to a range of manual or automatic operating levers (not shown) for selectively moving switching device 12 between its stable positions.

Figure 3:
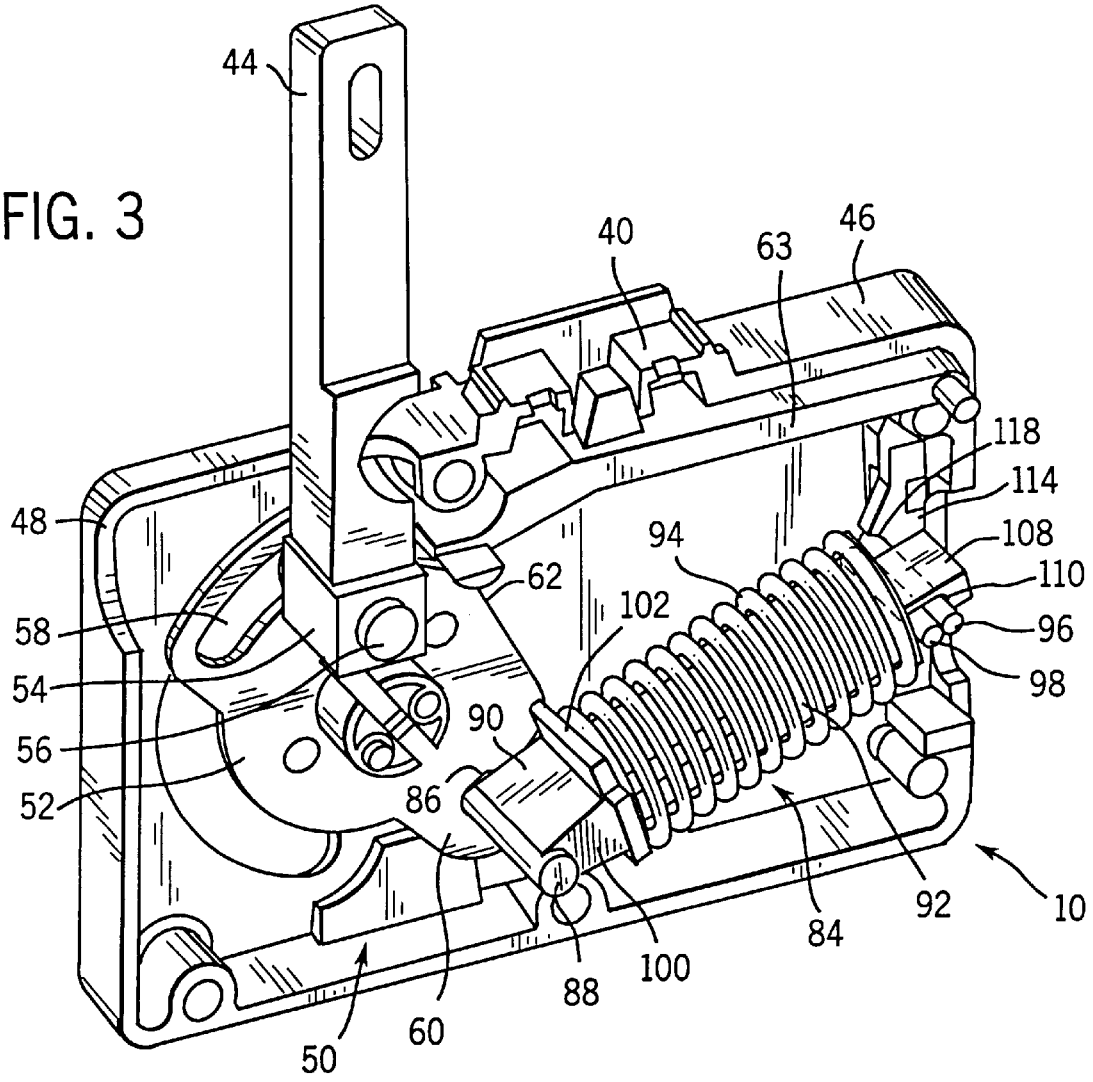
FIG. 3 is a side perspective view of a portion of the modular biasing assembly of FIGS. 1 and 2, wherein a side panel has been removed to expose certain of the internal functional elements of the assembly.

FIG. 3 illustrates certain of the internal functional components of biasing assembly 10 assembled within a portion of modular housing 28. As illustrated in FIG. 3, housing 28 comprises a housing shell 46, a portion of which has been removed for explanatory purposes. A recess 48 is formed in shell 46 to permit access to actuating lever 44. A snap-action mechanism, designated generally by reference numeral 50, is mounted within housing shell 46. Snap-action mechanism 50 includes a link plate 52 mounted on drive hub 33 for rotation with drive hub 33. Link plate 52 is coupled to actuating lever 44 via an actuator bearing 54 through which a link pin 56 is provided. Link pin 56 rides in an overtravel slot 58 formed in link plate 52. Link plate 52 further includes a biasing extension 60 for preloading a spring assembly and for urging link plate 52 between stable positions as described more fully below. A cam surface 62 is preferably formed adjacent to biasing extension 60 for controlling operation of an auxiliary contact operator 63. Auxiliary contact operator 63 is mounted within modular housing 28 and is moved by cam surface 62 to operate an auxiliary contact device 42 (shown in FIG. 2).

It should be noted that in the assembly illustrated in FIG. 3, an identical link plate 52 has been removed from drive hub 33 to facilitate viewing of the elements of snap-action mechanism 50. In the final assembly, however, an additional link plate 52 would be mounted on drive hub 33 and operatively connected to the other components of mechanism 50.

In addition to the features described above, link plate 52 includes a pair of first position stops 76 and 78 formed around its periphery. A pair of second position stops 80 and 82 are similarly formed around the periphery of link plate 52. A central aperture 72 is formed through link plate 52 (see, e.g., FIG. 4) for drivingly receiving drive hub 33. Actuator bearing 54 designed to extend between the pair of link plates following final assembly of mechanism 50, is bounded on either end by an extension of pin 54, which penetrates through overtravel slot 58 in each link plate 52. A clearance recess 74 is formed in each side of housing shell 46 to permit free movement of pin 56 therebetween.

Housing shell 46 includes a number of features designed to support and cooperate operatively with mechanism 50. Accordingly, apertures 75 are formed in either side of housing shell 46 for receiving and supporting drive hub 33 (see FIG. 2). Within housing shell 46, projections integral with shell 46 form a pair of first abutment surfaces 64 and 66, as well as a pair of second abutment surfaces 68 and 70 (see FIG. 4). Abutment surfaces 76 and 78 contact and cooperate with first position stops 64 and 66, respectively, of link plate 52 to hold link plate 52 in a first stable position against the force of a spring assembly 84, described in greater detail below. Similarly, abutment surfaces 80 and 82 contact and cooperate with second stop surfaces 68 and 70, respectively, to hold link plate 52 in a second stable position (shown in FIG. 8) against the force of spring assembly 84. As will be appreciated by those skilled in the art, the first stable position in which surfaces 76 and 78 bear against surfaces 64 and 66, respectively, will correspond to a first desired position of a switching device 12, such as a closed position wherein current carrying paths through switching device 12 are completed. The second stable position of mechanism 50 wherein surfaces 80 and 82 bear against stops 68 and 70, respectively, will correspond to a second desired position of switching device 12, such as a position in which current carrying paths through the device are interrupted.

Spring assembly 84 permits mechanism 50 to rapidly move link plate 52 and drive hub 33 between the first and second stable positions as well as to maintain these elements in each stable position following such movement. As best illustrated in FIGS. 3 through 8, spring assembly 84 includes a slot 86 formed in biasing extension 60 of link plate 52. A pin 88 is received in slot 86 and couples link plate 52 to a biasing link 90. A roller sleeve 92 is received about biasing link 90. A compression spring 94 is positioned about both biasing link 90 and sleeve 92 for urging roller bearings or pins 96 and 98 into stable positions as described more fully below. Pin 88 is fixed to a head or upper extension 100 of biasing link 90 about which an upper flange 102 is formed. Upper flange 102 serves to contact and bear against a first end of compression spring 94 at one end thereof. Sleeve 92 has an outer wall 104 slightly smaller in diameter than spring 94, such that spring 94 may be slipped over sleeve 92 during assembly of spring assembly 84. A lower flange 106 is formed about sleeve 92 for contacting and bearing against a second end of spring 92. Spring 92 thus extends between upper flange 102 of biasing link 90 and lower flange 106 of sleeve 92.

It should be noted that in the preferred embodiment illustrated, slot 86 is dimensioned so as to facilitate assembly of spring assembly 84. Specifically, slot 86 is positioned and dimensioned such that the force of spring 94 is exerted against biasing link 90 at both final or stable positions of the assembly as described in greater detail below. Because in the preferred embodiment biasing link 90 is made of a sturdy dye cast metal, whereas housing shell 48 is made of a non-conductive plastic, it is preferable that pin 88 exert force against link 90.

At a foot or lower end 108 of biasing link 90, link 90 includes a transverse slot 110 extending generally along an axis 112 of link 90. Pins 96 and 98 are positioned in slot 110 generally transverse to axis 112. Pin 98 bears against lower flange 106 of sleeve 92 and is in rolling contact with the flange surface as described below. Pin 98 is urged into rolling contact with pin 96 by spring 94. A bearing plate 114 is supported by an end wall 116 of each half of housing shell 46 for cooperating with spring assembly 84. In particular, bearing plate 114 includes a recess forming first and second stops 118 and 120, between which an elongated bearing surface 122 is formed. Once assembled as illustrated in the Figures, spring 94 urges pin 96 into rolling contact with surface 122 and into stable contact with first and second stops 120. A recess 126 is formed in the end of housing shell 46 adjacent to plate 114 to permit foot or lower end 108 of biasing link 90 to protrude through housing shell 46 during movement of spring assembly 84 as described below. It should be noted that in the preferred embodiment transverse slot 110 is closed by a portion of biasing link 90. This preferred configuration facilitates assembly of spring assembly 84 by effectively capturing pins 96 and 98 within biasing link 90.

Figure 4:
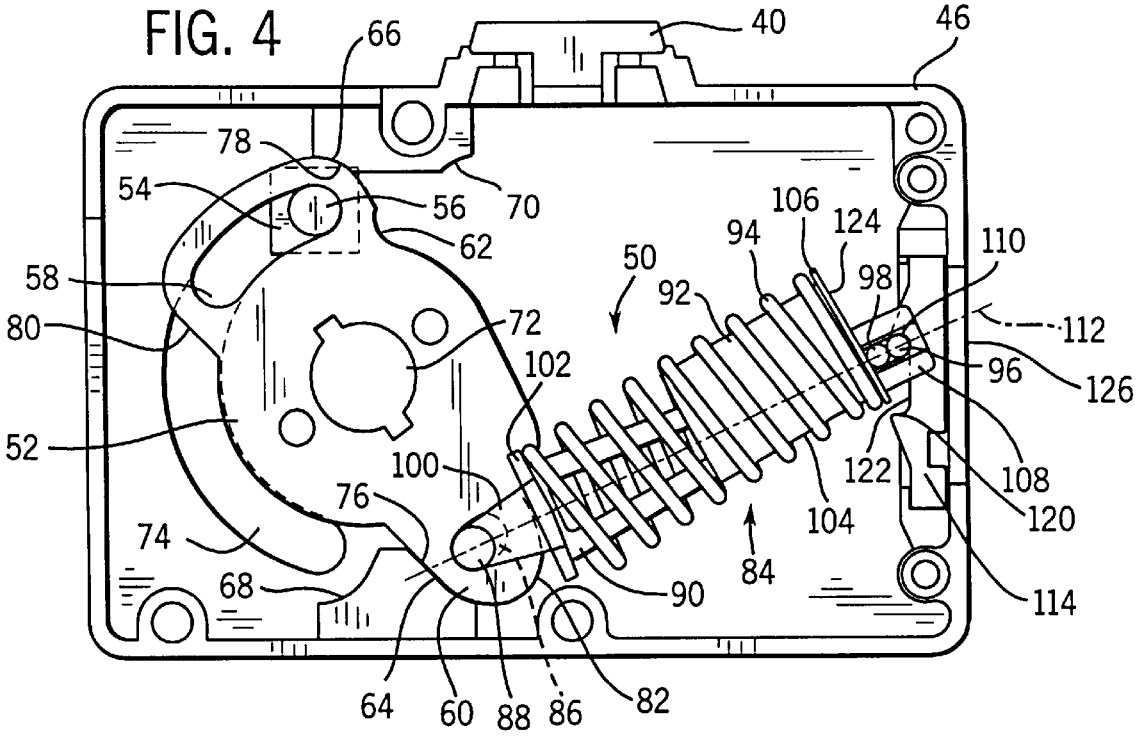
FIG. 4 is a side elevational view of the biasing assembly of the preceding Figures illustrating certain functional components in a first stable position.
Figure 5:
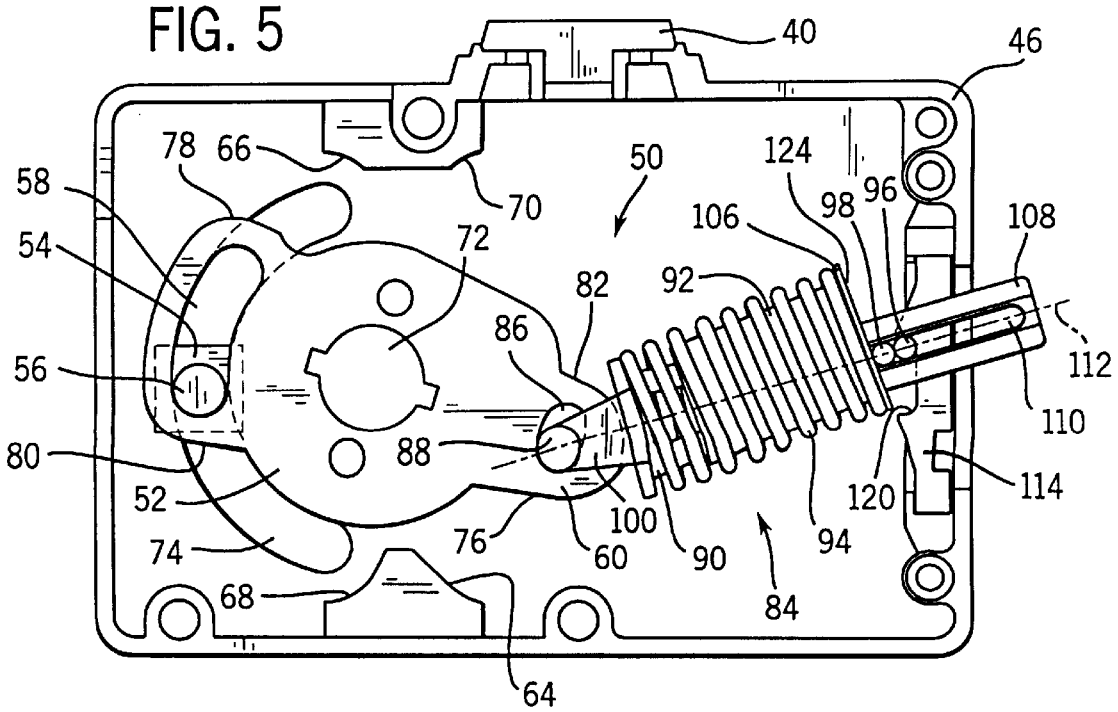
FIG. 5 is a side elevational view of the biasing assembly of FIG. 4 showing the functional elements during an initial or preloading phase of movement as they approach a break-over point.

Mechanism 50 operates to toggle between the first and second stable positions as follows. As shown in FIG. 4, in the first stable position of biasing assembly 10, compression spring 94 urges pin 96 into contact against first stop 118 of bearing plate 114. Pin 98 is held tightly between lower flange 106 of sleeve 92 and pin 96. Biasing link 90 is thus held in an extended position with respect to sleeve 92, urging pin 88 against an end of slot 86. The entire mechanism is stabilized by contact between first position stops 64 and 66 of housing shell 46 and abutment surfaces 76 and 78, respectively, of link plate 52. During an initial phase of motion, as illustrated in FIG. 5, actuator bearing 54 is displaced within overtravel slot 58, contacting an end of slot 58 to begin rotation of link plate 52 and drive hub 33. During this initial rotational phase of movement, pin 88 is held against the end of slot 86 by the force of compression spring 94. Similarly, pins 96 and 98 are held between lower flange 106 of sleeve 92 and first stop 118 of bearing plate 114. Spring assembly 84 pivots about pin 96 through this phase of movement. It should be also noted that, due to the form of aperture 26 of switching device 12 (see FIG. 2), although link plate 52 and hub 33 are rotated during this preloading phase of operation, drive member 36 does not begin to move rotating member 16 or contacts 18.

Figure 6:
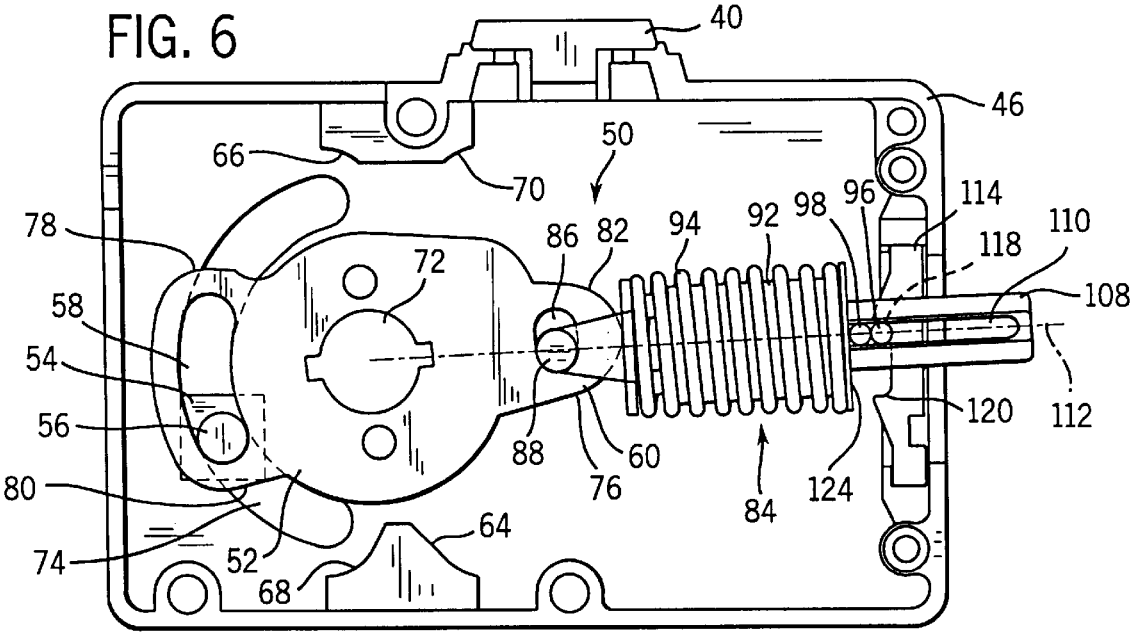
FIG. 6 is a side elevational view of the biasing assembly at the break-over point.

FIG. 6 illustrates the position of mechanism 50 just prior to rapid movement to its second stable bias position. As shown in FIG. 6, following full preloading of spring assembly 84, pins 96 and 98, and pin 88 securing biasing link 90 to link plate 52 become aligned with the rotational axis of drive hub 33 and link plate 52. Once pin 88 crosses this point, pins 96 and 98 are driven from first stop 118 of bearing plate 114, and roll towards second stop 120 along bearing surface 122. At the same time, pin 88 is displaced within slot 86 to urge link plate 52 and drive hub 33 rapidly toward the second stable position. As will be noted from the Figures, flange 102 of biasing link 90 preferably has a pair of beveled surfaces which allow spring 94 and sleeve 92 to pivot on axis 112 without bending the spring during movement of flange 106.

Figure 9:
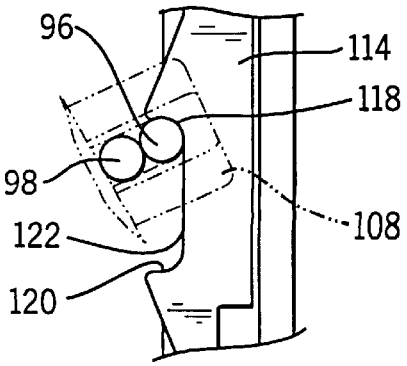
FIG. 9 is a detail view of roller elements of the biasing assembly in a stable position wherein they are urged against a stop portion of a support surface.
Figure 10:
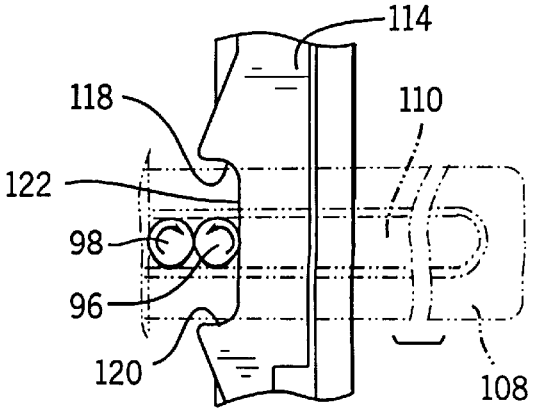
FIG. 10 is a detail view of the roller elements of the biasing assembly during their movement from the stop portion of the support surface as the biasing assembly is being transferred to its second stable position.

The preferred arrangement of pins 96 and 98 in the illustrated embodiment permits extremely rapid and low friction toggling action of biasing assembly 10. FIGS. 9 and 10 illustrate in detail the rolling contact of pins 96 and 98 during their movement between first stop 118 and second stop 120. As shown in FIG. 9, prior to toggling action of mechanism 50, pin 96 is held securely against first stop 118, pin 98 being held between lower flange 106 of sleeve 92 and pin 96. Once the mechanism begins to toggle, the pins are allowed to roll with respect to one another toward second stop 120 as illustrated in FIG. 10. During this motion, pin 96 drives pin 98 in rotation against lower flange 106. It should be noted that in the preferred embodiment illustrated, sleeve 92 fits loosely about the foot or lower end 108 of biasing link 90 so as to allow pin 98 to freely rotate with pin 96. Pin 98 thus drives sleeve 92 in translation with respect to biasing link 90, causing axes of spring 94 and biasing link 90 to cross one another, enhancing the toggling action of mechanism 50.

Figure 7:
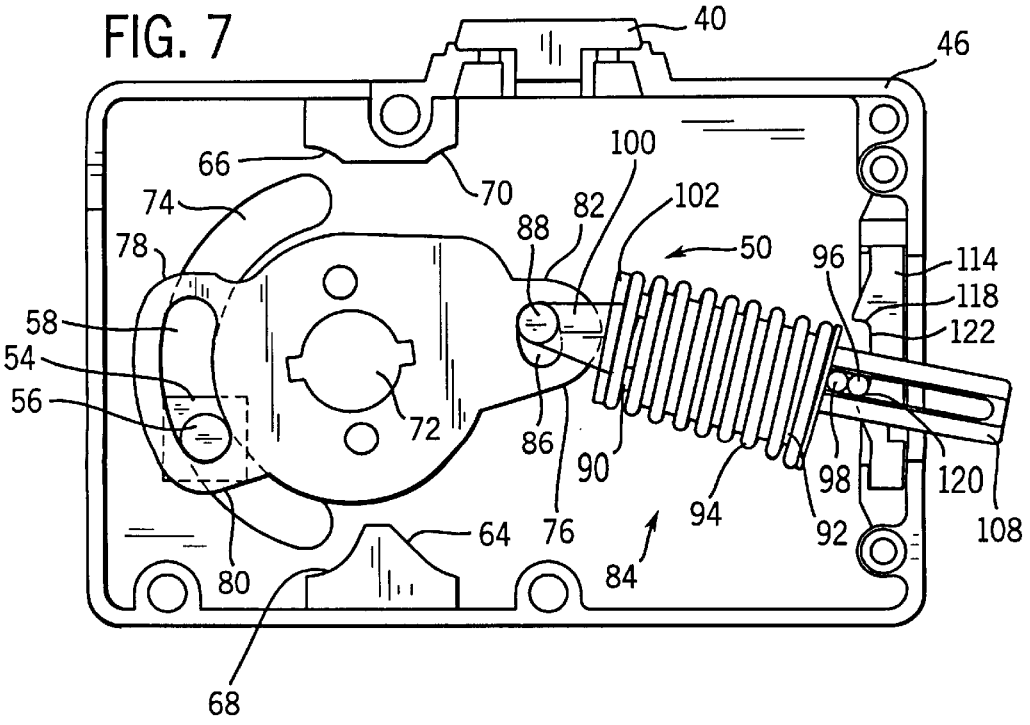
FIG. 7 is a side elevational view of the biasing assembly wherein the assembly has shifted past the break-over point.

As illustrated in FIG. 7, once mechanism 50 begins to toggle, spring 94 exerts its preloaded force against pin 88 and, through the end of slot 86, against link plate 52. Link plate 52, and drive hub 33, are thereby forced rapidly into their second stable position. Moreover, following rolling motion of pins 96 and 98 toward second stop 120 of bearing plate 114, pin 96 comes into contact with stop 120 to act as a pivot center for spring assembly 48. Upon movement of flange 106, the end of spring 94 abutting flange 102 of biasing link 90 pivots due to its relatively close fit about link 90 and sleeve 92. The spring and sleeve pivot freely due to the beveled surfaces of link 90 mentioned above. Furthermore, actuator bearing 54, along with pin 56, is urged toward the end of its stroke (i.e., toward the lower side of housing shell 46 as illustrated in the Figures).

Figure 8:
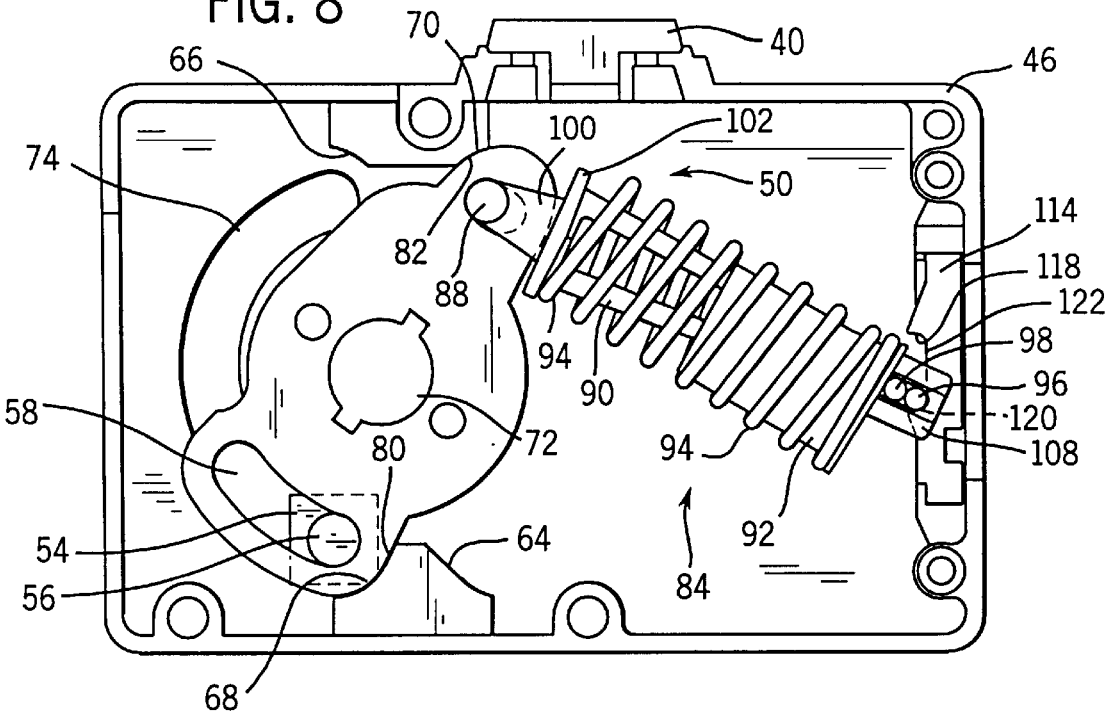
FIG. 8 is a side elevational view of the biasing assembly following movement of the functional elements to a second stable position.

As shown in FIG. 8, following this rapid toggling action, spring 94 is fully extended to urge pin 88 tightly against slot 86, and pin 96 against second stop 120. Similarly, second position stops 80 and 82 of link plate 52 are brought into contact with second abutment surfaces 68 and 70, respectively, at which point link plate 52 is brought to rest in its second stable position. Throughout movement of link plate 52 and hub 33 beyond the breakover point illustrated in FIG. 6, drive member 36 contacts the side of aperture 26 to force rotation of member 16 and contacts 18.

It should be noted that rapid movement of link plate 52 and drive hub 33 is unimpaired by actuator bearing 54 or other mechanical linkages and levers coupled to bearing 54 due to the position of bearing 54 within overtravel slot 58. In particular, because actuator bearing 54 is already located in an over-center position prior to rapid toggling of link plate 52, ink plate 52 may move quickly between the fully loaded position illustrated in FIG. 6 and the second stable position illustrated in FIG. 8 by movement of link plate 52 about bearing 54, along overtravel slot 58.

As will be appreciated by those skilled in the art, the foregoing sequence of movements between the first and second stable positions of biasing assembly 10 will typically correspond to movements of internal elements of switching device 12, such as from a conducting position to a non-conducting position. Biasing assembly 10 may be moved back from the second position illustrated in FIG. 8 to the first stable position illustrated in FIG. 4 by following the foregoing movements in reverse order. Moreover, the low friction, rapid movement of the biasing assembly afforded by rolling contact between pin 96 and bearing surface 122, and pin 98 and lower flange 106 of sleeve 92, is repeated in the reverse direction as mechanism 50 is preloaded and toggled from the second position to the first position.

It should be noted that, by virtue of the preferred embodiment of link plate 52, auxiliary operator 63 is caused to move within housing shell 46 along cam surface 62 to operate an auxiliary contact device. It should also be noted that by virtue of the foregoing structure, biasing assembly 10 may be mounted on either left or right sides of switching device 12. Moreover, the modular arrangement of biasing assembly 10 described above and illustrated in the Figures greatly facilitates separate manufacture of biasing assembly 10 and switching device 12, as well as their later assembly with one another in a finished biased switching unit.

While the invention may be susceptible to various modifications and alternative forms, specific embodiments have been shown and described herein by way of example only. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A biasing device for a switching mechanism, the switching mechanism including a switching element coupled to an actuator and movable with the actuator between a first position and a second position, the biasing device comprising:

a biasing link having a head portion and a foot portion, the head portion being coupled to the actuator;

a support surface, the support surface having a central portion bounded by first and second stop portions;

first and second roller elements coupled to the foot portion of the biasing link, the first and second roller elements contacting one another, the first roller element contacting the support surface; and means for urging the first and second roller elements away from the head portion of the biasing link, the means for urging contacting the second roller element;

whereby the biasing device is movable with rolling contact between the first roller element and the second roller element from a first stable position, wherein the device urges the actuator into the first position, to a second stable position, wherein the device urges the actuator into the second position.

2. The biasing device of claim 1, wherein the biasing link has a longitudinal axis and comprises an elongated slot extending substantially along the longitudinal axis, and wherein the roller elements are received within the elongated slot.

3. The biasing device of claim 2, wherein the biasing link is displaced during movement of the biasing device between the first and second stable positions such that the roller elements move within the elongated slot along the longitudinal axis.

4. The biasing device of claim 2, wherein the elongated slot is closed at a distal end of the biasing link to capture the roller elements therein.

5. The biasing device of claim 1, wherein the means for urging includes a compression spring disposed about the biasing link.

6. The biasing device of claim 1, wherein the means for urging includes a rolling surface urged into contact with the second roller element, the second roller element rolling along the rolling surface during movement of the biasing device between the first and second stable positions.

7. The biasing device of claim 1, wherein the first roller element contacts the first stop portion in the first stable position of the device and the second stop portion in the second stable position of the device.

8. The biasing device of claim 1, wherein the device further includes first and second stationary abutment surfaces, configured to contact respective first and second movable abutment surfaces of an actuator in the first and second positions.

9. An actuator assembly for urging a switching device into first and second positions, the assembly comprising:

an enclosure;

a mechanical linkage extending between the enclosure and the switching device;

an actuator rotatably disposed in the enclosure; and a biasing assembly disposed in the enclosure and coupled to the actuator, the biasing assembly including a biasing link coupled to the actuator, a pair of roller elements coupled to the biasing link, and a biasing spring, the biasing spring urging the roller elements against one another, whereby the biasing assembly is movable with rolling engagement between roller elements to urge the biasing link, the actuator, and the mechanical linkage into a first stable position corresponding to the first position of the switching device and into a second stable position corresponding to the second position of the switching device.

10. The actuator assembly of claim 9, wherein the biasing assembly includes a support surface comprising a central portion bounded by first and second stop portions, and wherein a first of the roller elements rolls along the central portion during movement of the biasing assembly and abuts the first and second stop portions in the first and second stable positions of the biasing assembly, respectively.

11. The actuator assembly of claim 10, wherein the biasing assembly includes a roll sleeve, and wherein the biasing spring extends between the roll sleeve and the biasing link to urge the roll sleeve against a second of the roller elements.

12. The actuator assembly of claim 9, wherein the rolling elements are cylindrical pins received within an elongated slot formed in the biasing link.

13. The actuator assembly of claim 12, wherein the rolling elements are displaced with respect to the biasing link along the elongated slot during movement of the biasing assembly between the first and second stable positions.

14. The actuator assembly of claim 9, wherein the switching device has right and left sides, and wherein the enclosure and mechanical linkage are configured for mounting to either the right or left side of the switching device.

15. A modular biasing assembly for urging a switching device into first and second positions, the switching device having left and right sides, the biasing assembly comprising:

a modular housing configured for mounting to either the left or the right side of the switching device;

a mechanical linkage extending between the housing and the switching device; and a toggle assembly, the toggle assembly being disposed within the housing and including an actuator, a biasing link, a biasing spring and a pair of rollers, the biasing spring urging the rollers into contact with one another, whereby the actuator is movable between positions corresponding to the first and second positions of the switching device with rolling movement of the rollers against one another.

16. The modular biasing assembly of claim 15, wherein the actuator is rotatably mounted in the housing and includes an actuator interface, and wherein the mechanical linkage is a removable element interchangeably engagable with left and right sides of the actuator interface.

17. The modular biasing assembly of claim 16, wherein the actuator interface includes an elongated slot and the mechanical linkage includes a tang insertable in the elongated slot.

18. The modular biasing assembly of claim 17, wherein the actuator includes first and second movable abutment surfaces, and wherein the housing further includes first and second stationary abutment surfaces, the first and second moveable abutment surfaces contacting the first and second stationary abutment surfaces in positions of the toggle assembly corresponding to the first and second positions of the switching device.

19. The modular biasing assembly of claim 15, wherein the toggle assembly includes a support surface comprising a central portion bounded by first and second stop portions, and wherein a first of the rollers rolls along the central portion during movement of the toggle assembly and abuts the first and second stop portions in positions of the toggle assembly corresponding to the first and second positions of the switching device.

20. The modular biasing assembly of claim 15, wherein the biasing link has a longitudinal axis and comprises an elongated slot extending substantially along the longitudinal axis, and wherein the rollers are received within the elongated slot.

21. The modular biasing assembly of claim 20, wherein the biasing link is displaced during movement of the actuator such that the rollers move within the elongated slot along the longitudinal axis.

* * * * *